US006732957B2

(12) United States Patent
Kanaya et al.

(10) Patent No.: US 6,732,957 B2
(45) Date of Patent: May 11, 2004

(54) FLOW CHANNEL SWITCHING DEVICE, AND SHOWER UNIT HAVING THE SAME

(75) Inventors: Keigo Kanaya, Otsu (JP); Yasuo Yonezawa, Otsu (JP)

(73) Assignee: Toray Industries, Inc. (JP)

( * ) Notice: Subject to any disclaimer, the term of this patent is extended or adjusted under 35 U.S.C. 154(b) by 145 days.

(21) Appl. No.: 09/937,199

(22) PCT Filed: Jan. 30, 2001

(86) PCT No.: PCT/JP01/00597

§ 371 (c)(1),
(2), (4) Date: Sep. 21, 2001

(87) PCT Pub. No.: WO01/56445

PCT Pub. Date: Aug. 9, 2001

(65) Prior Publication Data

US 2002/0152549 A1 Oct. 24, 2002

(30) Foreign Application Priority Data

Feb. 2, 2000 (JP) ..... 2000-024972
Mar. 6, 2000 (JP) ..... 2000-060084

(51) Int. Cl.[7] ..... A62C 31/00; B05B 7/02

(52) U.S. Cl. ..... 239/443; 239/436; 239/553; 239/525

(58) Field of Search ..... 239/443, 444, 239/447, 448, 436, 440, 590, 590.3, 310, 315, 316, 569, 579, 581.1, 581.2, 582.1, 553, 525, 526, 527; 210/263, 504, 282, 283, 449

(56) References Cited

U.S. PATENT DOCUMENTS 4,783,258 A * 11/1988 Willinger et al. ..... 210/169
4,933,080 A * 6/1990 Rundzaitis et al. ..... 210/232
4,989,279 A * 2/1991 Powell ..... 4/612
5,152,464 A * 10/1992 Farley ..... 239/553.3
5,632,446 A * 5/1997 Krochek ..... 239/381
5,772,119 A * 6/1998 Someya et al. ..... 239/315
6,056,875 A * 5/2000 Farley ..... 210/263

FOREIGN PATENT DOCUMENTS

EP 0656503 A1 * 7/1995 ..... F16L/55/05
JP 59-11023 3/1984
JP 05-007866 1/1993
JP 09-299832 11/1997
JP 11-009485 1/1999

* cited by examiner

*Primary Examiner*—Davis Hwu
(74) *Attorney, Agent, or Firm*—Piper Rudnick LLP

(57) ABSTRACT

A flow path switching device comprising two flow paths having pressure losses different from each other, and a valve body provided corresponding to one of the two flow paths which has a lower pressure loss, the two flow paths being switched by opening/closing the flow path having the lower pressure loss with the valve body, and a shower unit having the flow path switching device. It is possible to provide a low pressure-loss flow path switching device for which it is not necessary to open/close the two flow paths at the same time and which is simple in construction and can save space. Further, if this flow path switching device is used in a purified water shower unit having a raw water flow path and a purified water flow path, then it is possible to provide a purified water shower unit which ensures that switching operation can be performed easily by one hand, that a filter material can sufficiently maintain its shape even when water pressure is applied to the filter material, that the filter material is worn off efficiently over the whole, and that space in the unit is efficiently used.

24 Claims, 6 Drawing Sheets

FLOW CHANNEL SWITCHING DEVICE, AND SHOWER UNIT HAVING THE SAME

TECHNICAL FIELD OF THE INVENTION

The present invention relates to a flow path switching device which can be suitably applied to a shower unit and the like disposed in a bathroom, etc. and used for washing a human body, etc., and specifically to a flow path switching device applied suitable to a shower unit which can create purified water by adsorbing and decomposing residual chlorine contained in service water, and a shower unit having the same.

BACKGROUND ART OF THE INVENTION

For example, as disclosed in JP-A-11-9485, a conventional flow path switching device, which is provided in a shower head and the like of a purified water shower unit and the like, switches a flow path to be selected by closing one flow path among two flow paths by a valve body as well as by opening the other flow path. Namely, the respective two flow paths must be opened/closed simultaneously, thereby making the structure complicated. By this complication in structure, the pressure loss increases, the discharge amount of the shower decreases, and user's comfortableness may be damaged. Further, because it is very difficult to dispose the complicated mechanism in a limited space in a shower head, the size of a shower head having the conventional flow path switching mechanism becomes large as the whole or partially, thereby injuring its appearance.

Further, a conventional purified water shower unit removing or decomposing residual chlorine contained in service water and having means for switching raw water and purified water, is constructed, for example, as shown in FIG. 5. Purified water shower unit 100 depicted in FIG. 5 has a shower head 101 and a shower grip 102, and raw water is introduced into a switching device 103 and distributed to a purified water flow path "b" having therein a filter material 104 and a raw water flow path "a" bypassing the filter material 104. Raw water or purified water having passed through filter material 104 is led to the head portion, and discharged as shower. Thus, in a conventional purified water shower unit, because flow path switching device 103 is disposed at an upstream side of filter material 104, it is necessary for a user to use both hands in order to switch flow paths as shown in FIG. 6.

Moreover, in the conventional purified water shower unit 100, filter material 104 is formed as a cylindrical shape and raw water flows into the cylindrical filter material 104 from its outer side surface, and by this structure, the inflow cross-sectional area of the filter material 104 is ensured to be large and its flow path resistance is reduced.

In such a purified water shower unit 100 having switching device 103 for switching raw water flow path "a" and purified water flow path "b", after raw water is introduced into switching device 103, it is distributed to the periphery side and the inner circumferential side of filter material 104 by the switching device 103, and the inner circumferential side is made into the raw water flow path "a" and the periphery side is made into the purified water flow path "b". When raw water is led to the inner circumferential side, the raw water passes through the inner circumferential side as it is, and introduced into shower head 101 and then discharged as shower water. When raw water is led to the periphery side of filter material 104, the raw water flows from the periphery of the filter material 104 to the inner circumferential side of the filter material 104 through the filter material 104, and introduced into shower head 101 and then discharged as purified water shower.

Thus, in the conventional purified water shower unit, since the purified water flow path "b" is formed so as to make water flow from the periphery to the inner circumferential side of filter material 104, pressure operates on the filter material 104 in a direction toward the center. Therefore, a reinforcement member 105 for a filter material, such as a cylindrical member made of a porous plastic or a plastic having many holes, is required at the inner circumferential side of the filter material 104.

Namely, in the conventional purified water shower unit 100, because switching device 103 for switching raw water flow path "a" and purified water flow path "b" is disposed at a position upstream of filter material 104 and reinforcement member 105 is required at a center position of the cylindrical filter material 104, when a user switches the flow path during use of the shower, the user has to switch using both hands as shown in FIG. 6, and the shower unit is large in shape by a volume corresponding to the reinforcement member 105, or, the water purification ability thereof is low.

DISCLOSURE OF THE INVENTION

An object of the present invention is to provide a flow path switching device which has a simple structure and can save space, and which can achieve a low pressure loss, and a shower unit equipped with the flow path switching device.

Another object of the present invention is to provide a purified water shower unit having a switching device between a raw water flow path and a purified water flow path, in which the switching operation can be performed by one hand, a shape of a filter material can be sufficiently maintained even if a water pressure is applied to the filter material, and the filter material is efficiently worn off over the whole and the space in the unit can be efficiently used.

To accomplish the above objects, a flow path switching device according to the present invention comprises two flow paths having pressure losses different from each other, and a valve body provided corresponding to one of the two flow paths which has a lower pressure loss, and the two flow paths are switched by opening/closing the flow path having a lower pressure loss with the valve body.

Where, it is preferred that the pressure loss of the flow path with a lower pressure loss is in a range of 1/5 to 1/20 of a pressure loss of the other flow path.

A shower unit according to the present invention comprises such a flow path switching device. It is constructed as a shower unit capable of switching between raw water and purified water by providing a filter material in the shower unit.

The shower unit according to the present invention is suitable as a purified water shower unit equipped with a filter material. Namely, a shower unit according to the present invention comprises a cylindrical filter material, a raw water flow path, a purified water flow path, and a flow path switching device constructed so that the raw water flow path and the purified water flow path are switched by opening/closing the raw water flow path.

Particularly, this shower unit may be constructed so that raw water flowing in the purified water flow path flows from inside of the cylindrical filter material toward outside thereof. The purified water flow path may be always opened.

Further, in this shower unit, it is preferred that the flow path switching device is provided at a position downstream of the filter material.

Furthermore, it is preferred that the filter material is formed using a sulfite or an activated carbon, and calcium sulfite is desired as the used sulfite and fibrous activated carbon is desired as the used activated carbon.

Although the filter material is provided in a housing, a part of or the whole of the housing enclosing the filter material may be transparent.

Further, preferably a reinforcement member with a water permeable property is disposed on a periphery of the filter material, more preferably, the reinforcement member with a water permeable property is formed from a nonwoven fabric, and further more preferably, such a reinforcement member with a water permeable property is layered around the periphery of the filter material. Further, it is preferred that a pressure loss due to the reinforcement member with a water permeable property is higher than a pressure loss due to the filter material.

Further, it is preferred that a water permeation resistance of the inflow side of the filter material, that is, a water permeation resistance at a periphery side of the filter material, is greater than a water permeation resistance of the outflow side of the filter material, that is, a water permeation resistance at an inner circumferential side of the filter material.

In the above-described flow path switching device according to the present invention, since two flow paths and a valve body equipped corresponding to one of the two flow paths which has a lower pressure loss are provided and the device is constructed so that the two flow paths are switched by opening/closing the flow path having a lower pressure loss with the valve body, it is not necessary to open/close the two flow paths at the same time, the device may be constructed to be simple in construction and so as to be able to save space as compared with a conventional device, and the pressure loss can be reduced.

When such a flow path switching device is provided in a shower unit, the switching operation of flow paths is easy in spite of a space saving switching device, and a comfortable shower unit capable of achieving a sufficient amount of shower discharge can be realized.

Further, in the above-described purified water shower unit according to the present invention, a filter material is formed as a cylindrical shape, and in both cases of purifying raw water and passing raw water, the raw water is introduced into the inner circumferential side of the cylindrical filter material, an outlet port of the raw water flow path can be provided at the inner circumferential side of the filter material and at a position opposite to an inlet port of the raw water flow path, and an outlet port of the purified water flow path can be provided at the periphery side of the filter material. And, in such a construction, raw water introduced into the purified water flow path is flown from the inner circumferential side of the filter material toward the periphery side thereof, the internal pressure is made as a dominant pressure applied to the filter material, and because the internal pressure applied to the filter material can be supported by the reinforcement member with a water permeable property which is disposed at the periphery side of the filter material, a conventional reinforcement member, which has been required to be provided at an inside position of a cylindrical filter material, basically becomes unnecessary. By using a thin and strong nonwoven fabric and the like for the reinforcement member with a water permeable property provided at the periphery side of the filter material, the capacity occupied by the reinforcement member with a water permeable property can be made smaller than a capacity occupied by a conventional reinforcement member, thereby making the unit small or increasing the amount of the filter material. Therefore, as compared with a conventional unit, a purified water shower unit having a high ability while being made small as a whole can be realized.

Further, by providing means for opening/closing the raw water flow path, that is, the flow path switching device, at a position downstream of the filter material, when the raw water flow path is closed, an opening flow path is only the purified water flow path, and when the raw water flow path is opened, although the purified water flow path is also opened, because there is a pressure loss due to the existence of the filter material in the purified water flow path, the raw water flows selectively through the raw water flow path, and therefore, raw water and purified water can be selectively discharged by the flow path switching device which opens/closes the raw water flow path. Namely, because the switching device can be provided at a position of fingers of a hand of a user holding the shower body, the user can switch between raw water and purified water by one hand.

Further, an appropriate degree of pressure loss can be generated at a position of the reinforcement member with a water permeable property by layering the reinforcement member with a water permeable property on the periphery of the filter material at an appropriate amount, and the flow of the raw water flowing in the filter material can be made uniform and the filter material can be efficiently worn off over the whole by making the pressure loss of the reinforcement member with a water permeable property higher than the pressure loss of the filter material.

Furthermore, in the purified water shower unit according to the present invention, it is also possible to observe and check a flow, a dirt, etc. in the housing by making a part of or the whole of the portion of the housing enclosing the filter material transparent.

Thus, in the present invention, an excellent purified water shower unit can be provided, wherein the switching operation can be performed by one hand, the switching mechanism is a simple structure, the shape of the filter material can be sufficiently maintained even if a water pressure is applied to the filter material, and the filter material is worn off efficiently over the whole and the space in the unit is efficiently used.

THE BEST MODE FOR CARRYING OUT THE INVENTION

Hereinafter, desirable embodiments of the present invention will be explained referring to the figures.

Figure 1:
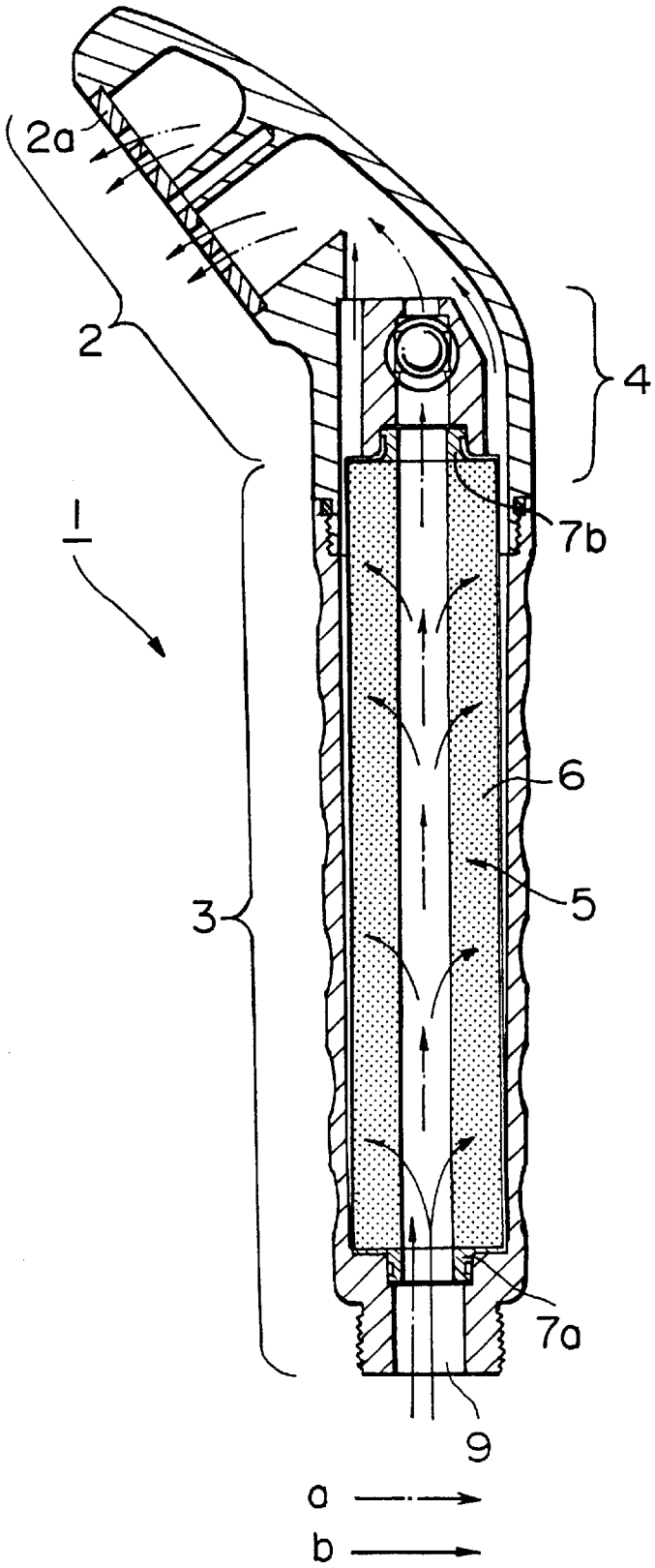
FIG. 1 is a vertical sectional view of a shower unit according to an embodiment of the present invention.

A flow path switching device according to the present invention has two flow paths, and a valve body provided corresponding to one of the two flow paths which has a lower pressure loss, the device is constructed so that the two flow paths are switched by opening/closing the flow path having a lower pressure loss with the valve body, and for example, as shown in FIG. 1, it is suitably used for a shower unit, etc. provided in a bathroom, etc.

In this shower unit, the switching operation between the raw water flow path and the purified water flow path can be performed by one hand, the shape of the filter material can be sufficiently maintained even if a water pressure is applied to the filter material, and the filter material is worn off efficiently over the whole and the unit can be suitably used as a purified water shower unit which uses the space in the unit efficiently.

Figure 2:
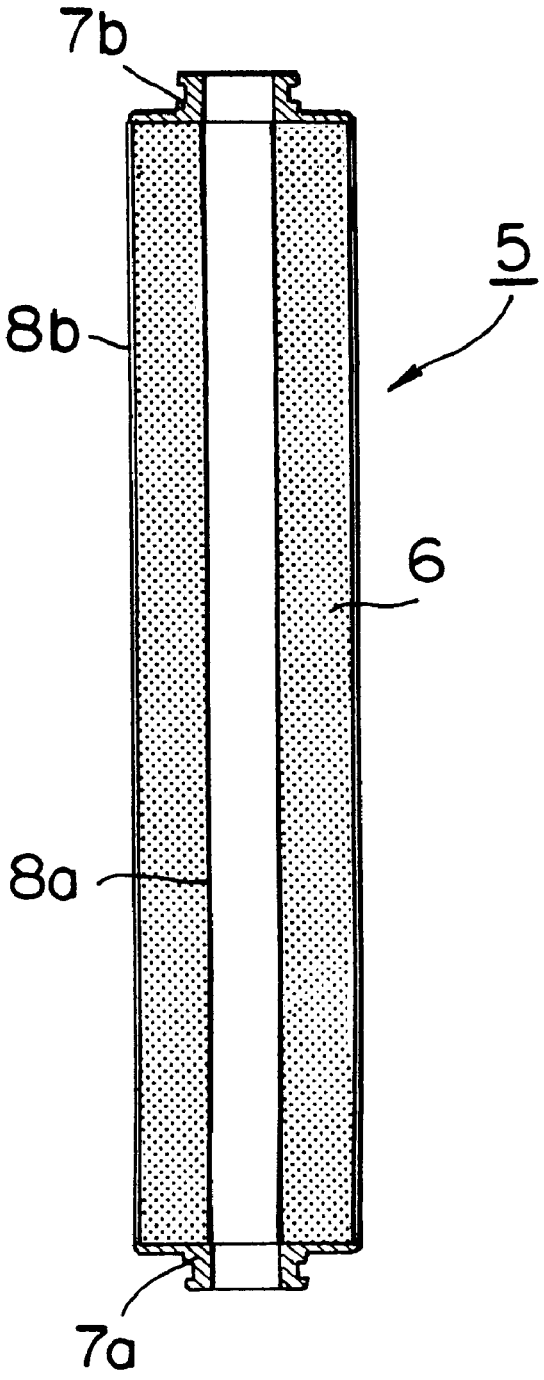
FIG. 2 is a vertical sectional view of a filter material in the shower unit depicted in FIG. 1.

FIG. 1 shows a shower unit 1 according to an embodiment of the present invention. In FIG. 1, shower unit 1 has a shower head 2, shower grip 3, a flow path switching device 4, and a cartridge 5. As shown in FIG. 2, cartridge 5 comprises a cylindrical filter material 6, filter material caps 7*a*, 7*b*, and reinforcement members with a water permeable property 8*a*, 8*b*. Although reinforcement member 8*b* of the periphery side of the filter material preferably has a filter material reinforcing function and a desired pressure loss generating function as described later, reinforcement member 8*a* of the inner circumferential side of the filter material may be one merely having a filter material formation holding function. A water splashing member 2*a* for discharging the raw water or the water purified by filter material 6 as a shower flow is provided in shower head 2. A part of or the whole of a housing, formed from shower grip 3 containing filter material 6 and shower head 2, may be transparent. By the transparent structure, the clogging condition or the life of the filter material can be checked by observation from outside.

Figure 3:
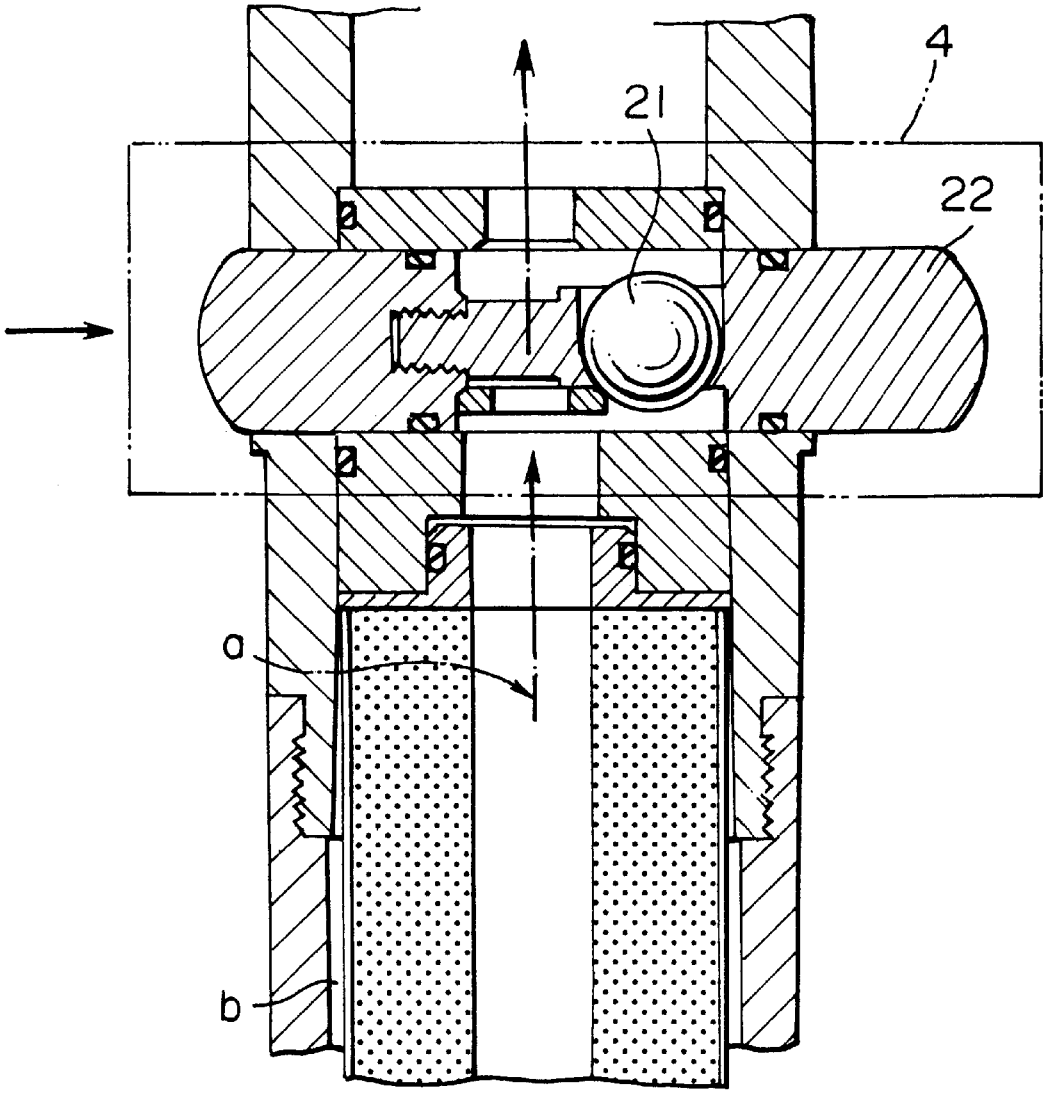
FIG. 3 is a view of a flow path switching device of the shower unit depicted in FIG. 1 (at the time of raw water selection) as viewed from the left side in FIG. 1.
Figure 4:
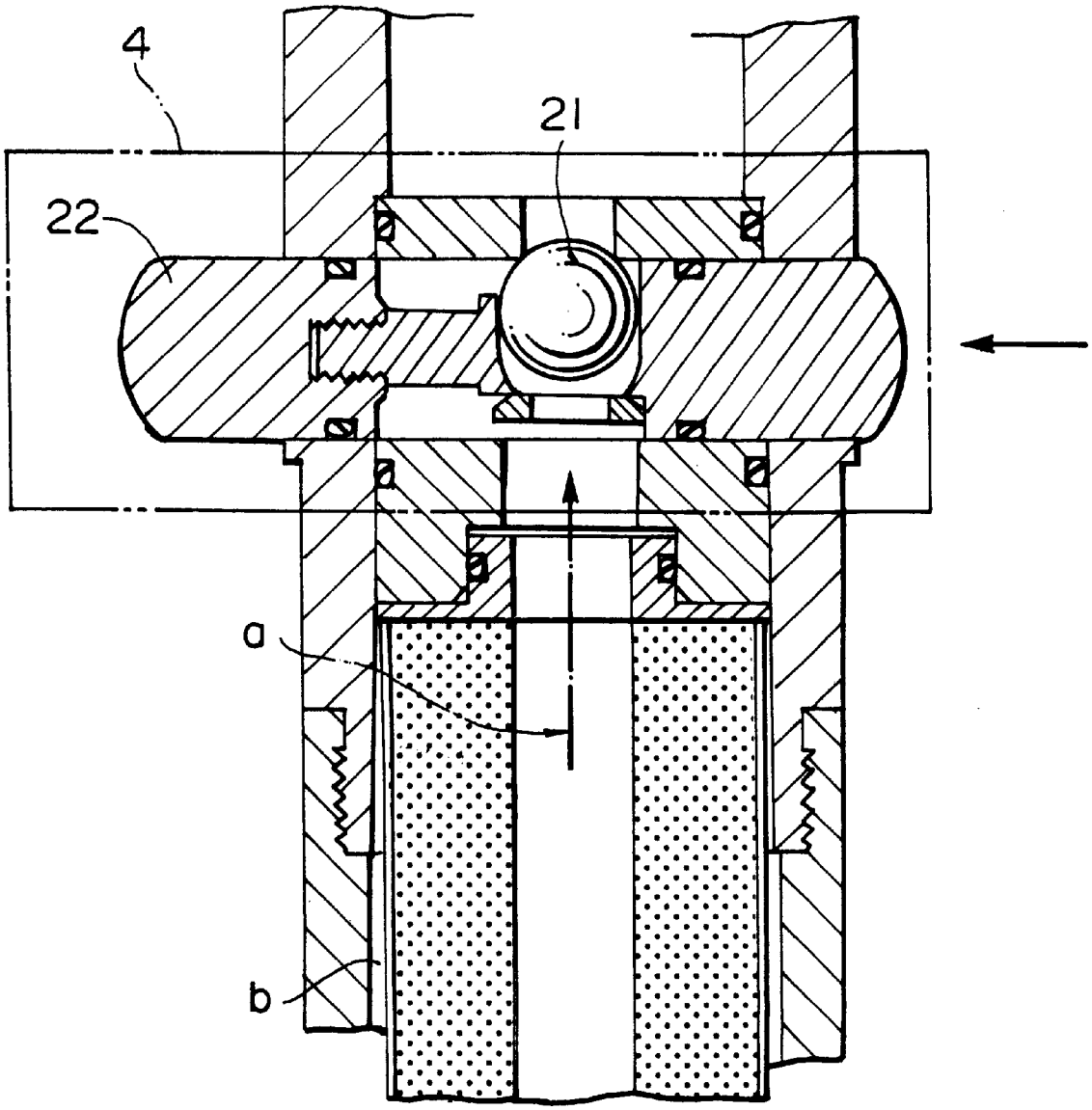
FIG. 4 is a view of a flow path switching device of the shower unit depicted in FIG. 1 (at the time of purified water selection) as viewed from the left side in FIG. 1.
Figure 5:
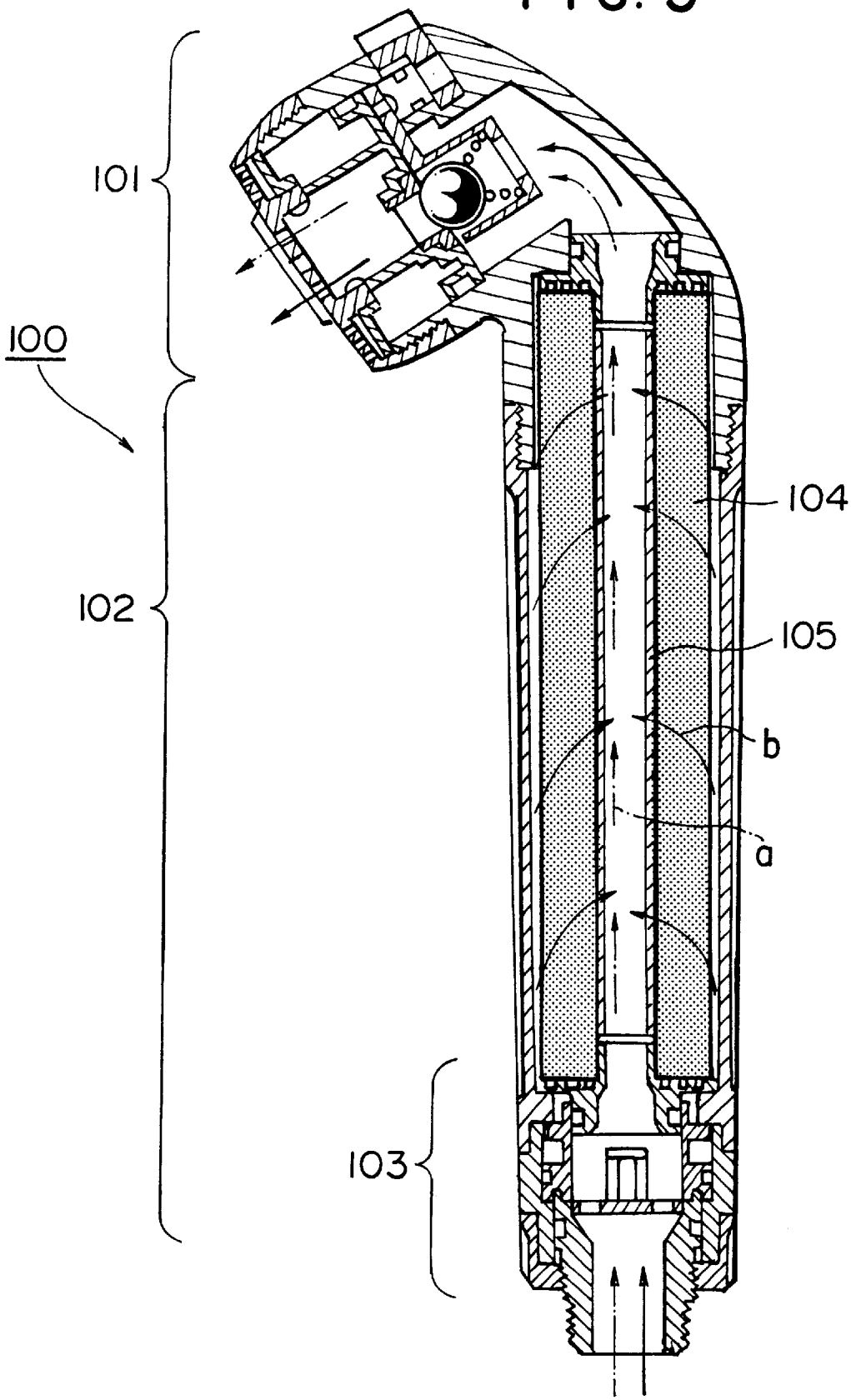
FIG. 5 is a sectional view showing an example of a conventional purified water shower unit.
Figure 6:
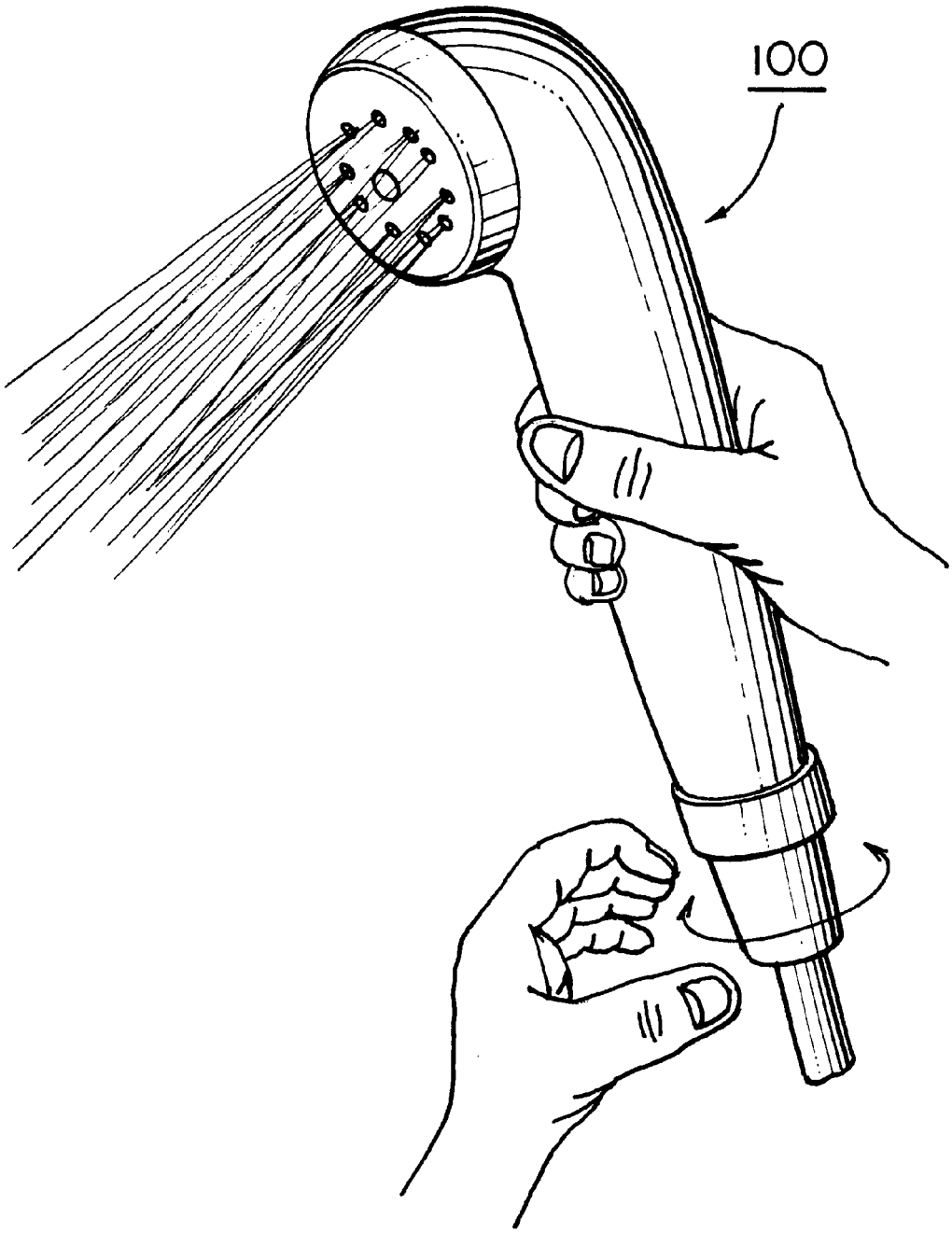
FIG. 6 is a schematic perspective view showing an example of the switching operation in the purified water shower unit depicted in FIG. 5.

Flow path switching device 4 is structured as a water flow stop valve, and it is provided only in a raw water flow path "a" (shown by the chain lines in FIG. 1). As shown in FIGS. 3 and 4, flow path switching device 4 is constructed from a valve body 21, a main shaft 22 functioning as an operational piece, etc., and the valve body 21 opens/closes the raw water flow path "a" which has a pressure loss lower than that of a purified water flow path "b" (shown by the solid lines in FIG. 1) and the flow paths are switched by the opening/closing operation. The purified water flow path "b" has no valve body and is always opened.

Valve body 21 may be a valve capable of opening/closing the raw water flow path, such as a sphere body or a spherical body, further, such as a butterfly valve or a slide valve. As the material of the valve body, a rubber, a plastic, a metal, etc. can be used, and in a case of a sphere body or a spherical body, in order to improve both the sealability and the operationability, it is preferred to use a plastic or metal sphere body or spherical body coated with a rubber.

As filter material 6, for example, a fibrous activated carbon removing chlorine and mold smell which cause uncomfortableness, a hollow fiber membrane removing bacteria and suspended substance, further, an ion exchange resin removing heavy metals, etc. can be used. In a case using a fibrous activated carbon, it is preferred to form it in a cylindrical shape because the pressure loss due to the filter material can be easily adjusted.

In the present invention, in a case where the destination of the discharged fluid is the same and the path for the fluid is merely divided into two flow paths by providing a partition, the condition is referred to as a single fluid path.

Next, the flow of water in shower unit 1 shown in FIG. 1 will be explained.

The raw water flown in from raw water inlet port 9 is discharged from water splashing member 2*a* through a flow path selected by flow path switching device 4.

The selection of flow path is performed by pushing main shaft 22 of flow path switching device 4 from either left or right direction, thereby opening/closing the raw water flow path "a", as shown in FIGS. 3 and 4. The condition shown in FIG. 3 is a condition selecting raw water. When main shaft 22 is pushed from the left direction in the arrow's direction (from the left direction to the right direction in the figure), valve body 21 moves to a position out of the raw water flow path, the raw water does not flow into filter material 6 but flows in the raw water flow path "a" as it is, and is discharged from water splashing member 2*a*. At that time, although the purified water flow path "b" and the raw water flow path "a" are both in an opened condition, since the purified water flow path "b" has a pressure loss higher than that of the raw water flow path "a" because of filter material 6, the raw water substantially flows only in the raw water flow path "a" and flows out from water splashing member 2*a*. The condition shown in FIG. 4 is a condition selecting purified water. When main shaft 22 is pushed in the arrow's direction (from the right direction to the left direction in the figure), valve body 21 moves to a position above the axis of the raw water flow path "a" as well as comes into contact with the downstream side raw water flow path "a" by the water pressure, and closes the raw water flow path "a". Therefore, the raw water having entered into shower unit 1 passes through filter material 6 and the purified water flow path (the purified water flow path present in the area downstream of filter material 6 is not shown), and flows out from water splashing member 2*a* as purified water. present invention, because the flow path is switched by operating the valve body to open/close a flow path having a lower pressure loss, differently from the conventional operation, it is not necessary to open/close a plurality of flow paths at the same time, the structure is simple and space can be saved as compared with the conventional technology, and the pressure loss of the switching device itself can be reduced.

In the embodiment shown in FIG. 1, although a difference of pressure loss between the two flow paths is made by the filter material, the pressure loss difference may be made by adjusting the areas of the flow paths, for example, by making the cross-sectional area of the purified water flow path smaller than the cross-sectional area of the raw water flow path, or by providing an orifice in the purified water flow path.

Further, in order to achieve substantially both to ensure an amount of water flown out from a flow path (a purified water flow path) when the purified water flow path having no valve body is selected and to prevent water from being leaked from a flow path having a valve body (a raw water flow path), the pressure loss of the flow path (raw water flow path) having a lower pressure loss and provided with a valve body is preferably in the range of 1/5 to 1/20 of the pressure loss of the other flow path (purified water flow path "b")

As mentioned above, when the above-described flow path switching device is provided to a shower device, the switching operation of flow paths is easy and a sufficient amount of discharged water can be ensured in spite of a space saving switching mechanism, and when a filter material is provided, chlorine, bacteria, etc. in raw water can be removed, and therefore, it becomes comfortable for a user.

In this embodiment, as filter material 6, a fibrous activated carbon formed as a cylindrical shape is used, a nonwoven fabric is disposed on the inner circumference of filter material 6 by an amount of one winding as a water permeable reinforcement member 8*a*, and the nonwoven fabric is layered on the periphery of the filter material by an amount of three times winding as a water permeable reinforcement member 8*b*.

The water permeable reinforcement member 8*b* on the periphery may be provided so that the pressure loss of the water permeable member portion on the periphery is higher than the pressure loss of filter material 6, and even if a pressure of service water is applied to cartridge 5, the water permeable reinforcement member 8*b* is not damaged and flowing out of filter material 6 can be prevented.

Raw water flow path "a" starts from inlet port 9 provided in shower grip 3, enters from the inside of filter material cap 7*a* to the inner circumferential side of filter material 6, and after passing through the inside of filter material cap 7*b* and switching device 4, it is introduced into shower head 2 and it communicates with the outside.

Purified water flow path "b" starts from inlet port 9 provided in shower grip 3, enters from the inside of filter material cap 7*a* to the inner circumferential side of filter material 6, and after passing through the filter material 6 and going out to the periphery side of the filter material 6, it is introduced into shower head 2 and it communicates with the outside.

The flow path switching device 4 is disposed at a position downstream of cartridge 5, and it is a mechanism for opening/closing only the raw water flow path "a".

Namely, when the raw water flow path "a" is closed by switching device 4, the raw water flows only into the purified water flow path "b", and when the raw water flow path "a" is opened by switching device 4, because the raw water selectively flows into the raw water flow path "a" whose pressure loss is lower than that of the purified water flow path "b" by a degree corresponding to that of no cartridge 5, the raw water flow path "a" and the purified water flow path "b" can be selectively switched by the switching device 4.

In this embodiment, the cylindrical filter material 6 is formed from a cylindrical fibrous activated carbon, and nonwoven fabrics 8*a*, 8*b* are wound on the periphery and inner circumference of the fibrous activated carbon.

Since switching device 4 can be disposed at a position of the downstream side of cartridge 5 as in this embodiment, a user of the purified water shower according to the present invention can select a flow path by easy operation using fingers of a hand holding the purified water shower. Besides, because the switching device 4 has few parts as compared with a conventional switching device used for purified water and it can be structured more simply, its assemble is easy and the cost for manufacturing it is inexpensive as compared with a conventional one.

The purified water flow path "b" is formed so that the raw water flowing in the purified water flow path "b" passes the cylindrical filter material 6 from its inside toward its outside. The purified water having passed through the filter material 6 flows into shower head 2 through a purified water flow path formed between the periphery of the filter material 6 and shower grip 3.

In this embodiment, nonwoven fabrics 8*a*, 8*b* are disposed on both the periphery side and the inner circumferential side of the filter material 6, and in particular, the periphery side nonwoven fabric 8*b* is wound such that its pressure loss becomes within the range 1.2 to 1.5 times of the pressure loss of the filter material 6.

In purified water shower unit 1 thus constructed, when the water flow of the raw water flow path "a" is stopped by switching device 4, the raw water is introduced into the inside of filter material 6, flows into the interior of the filter material 6 from the inside of the filter material 6, passes through the filter material 6 toward outside, flows from the periphery side of the filter material 6 into shower head 2, and therefrom, is discharged to the outside as a purified water shower.

Alternatively, when the raw water flow path "a" is opened by switching device 4, the raw water is introduced into the inside of filter material 6, passes selectively through the inside of the filter material 6 with a low pressure loss as it is, and after passing through the inside of shower head 2, it is discharged to the outside as a raw water shower.

Therefore, because raw water flows into the inside of filter material 6 at both times of raw water selection and purified water selection, in any time, water pressure acts to the inner circumferential side of the filter material 6, and the water pressure is not applied from the periphery side of the filter material 6. Namely, in order to let the filter material 6 have a water pressure resistance, it may be necessary to take into consideration only the water pressure applied from the inside of the filter material 6.

In the purified water shower unit according to the present invention, when water pressure acts from the inside of filter material 6, because the formation of the filter material 6, which is likely to deform in the radially outer direction, is maintained by the tension of nonwoven fabric 8*b* provided on the periphery side of the filter material 6 as a water permeable reinforcement member, even if there is no reinforcement member supporting the filter material 6 from its inside, it can have a sufficient water pressure resistance. Further, because the nonwoven fabric 8*b* has a tensile strength enough to support the filter material 6 even if the water permeable resistance of the nonwoven fabric 8*b* is small, the water permeable resistance can be reduced as compared with a case of the reinforcement using a conventional core. In addition, because the tension of the nonwoven fabric 8*b* supports the filter material 6, the nonwoven fabric 8*b* itself may be a thin member, and its occupation space may be small.

Further, in a case where water flows from the inside to the outside of filter material 6, when nonwoven fabric 8*b* is merely wound on the outside, even if it is sufficient in water pressure resistance, there is a possibility that raw water drifts in the filter material 6 and the filter material 6 is worn off locally and inefficiently. In the purified water shower unit according to the present invention, however, because the nonwoven fabric 8*b* is wound on the periphery of the filter material 6 so that the pressure loss of the nonwoven fabric 8*b* becomes higher than the pressure loss of the filter material 6 and an appropriate pressure loss is given to the periphery of the filter material 6, the occurrence of a drift of raw water in the filter material 6 can be prevented, and reduction of the consumption efficiency of the filter material 6 can be prevented by passing the raw water uniformly through the filter material 6.

Further, in the purified water shower unit according to the present invention, because it is not necessary to provide a particular reinforcement member such as a conventional one to the filter material 6 itself, the cost is suppressed as well as it can be made small by the capacity for the particular reinforcement member.

In the above, because the nonwoven fabric 8*a* provided on the inner circumferential side of the filter material 6 is mainly for maintaining the formation of the filter material 6, a particular consideration is not necessary, but its pressure loss is preferably made as low as possible.

Thus, the above-described purified water shower unit has a water permeable resistance less than a conventional one, has a sufficient water pressure resistance even if filter material 6 is not reinforced by a particular reinforcement member, and the filter material 6 can be worn off efficiently over the whole. Further, as shown in FIG. 1, because such an excellent performance can be realized by a simple structure, the present invention can be performed inexpensively.

INDUSTRIAL APPLICATIONS OF THE INVENTION

In the flow path switching device according to the present invention, it is not necessary to open/close two flow paths at the same time, it can be constructed as a simple and space saving structure as compared with a conventional device, the pressure loss can be reduced, and therefore, it can be applied suitably to a shower unit. In the shower unit equipped with this flow path switching device according to the present invention, the purified water flow path and the raw water flow path can be easily switched by one hand, the form of the filter material can be sufficiently maintained even if a water pressure is applied to the filter material, the filter material can be worn off efficiently over the whole, and the space in the unit can be efficiently used, particularly, it can be suitably used as a purified water shower unit.

What is claimed is:

1. A shower unit having a flow path switching device which comprises two flow paths having pressure losses different from each other, a valve body provided corresponding to one of said two flow paths which has a lower pressure loss, said two flow paths being switched by opening/closing said flow path having a lower pressure loss with said valve body, and a filter material for one of the flow paths having a higher pressure loss, wherein the filter material is cylindrical, one of the flow paths having a lower pressure loss is a raw water flow path and the higher pressure loss flow path is a purified water flow path, and said purified water flow path is always opened, irrespective of opening or closing of the other flow path.

2. The shower unit according to claim 1, wherein the pressure loss of said flow path with a lower pressure loss is in a range of 1/5 to 1/20 of a pressure loss of the other flow path.

3. The shower unit according to claim 1, wherein raw water flowing in said purified water flow path flows from inside of said cylindrical filter material outwardly thereof.

4. The shower unit according to claim 1, wherein said filter material contains fibrous activated carbon.

5. The shower unit according to claim 1, wherein said filter material contains a sulfite.

6. The shower unit according to claim 5, wherein said sulfite is calcium sulfite.

7. The shower unit according to claim 1, wherein said filter material is provided in a housing, and a part of or the whole of said housing is transparent.

8. The shower unit according to claim 1, further comprising a reinforcement member with a water permeable property provided on a periphery of said filter material.

9. The shower unit according to claim 8, wherein said reinforcement member with a water permeable property is layered around the periphery of said filter material.

10. The shower unit according to claim 8, or 9, wherein said reinforcement member with a water permeable property is formed from a nonwoven fabric.

11. The shower unit according claim 8 or 9 wherein a pressure loss due to said reinforcement member with a water permeable property is higher than a pressure loss due to said filter material.

12. The shower unit according to claim 1, wherein a water permeation resistance at a periphery side of said filter material is greater than a water permeation resistance at an inner circumferential side of said filter material.

13. A shower unit having a flow path switching device which comprises two flow paths having pressure losses different from each other, a valve body provided corresponding to one of said two flow paths which has a lower pressure loss, said two flow paths being switched by opening/closing said flow path having a lower pressure loss with said valve body, a filter material for one of the flow paths having a higher pressure loss, and a flow path switching device provided at a position downstream of said filter material, wherein the filter material is cylindrical, one of the flow paths having a lower pressure loss is a raw water flow path and the higher pressure loss flow path is a purified water flow path.

14. The shower unit according to claim 13, wherein the pressure loss of said flow path with a lower pressure loss is in a range of 1/5 to 1/20 of a pressure loss of the other flow path.

15. The shower unit according to claim 13, wherein raw water flowing in said purified water flow path flows from inside of said cylindrical filter material outwardly thereof.

16. The shower unit according to claim 13, wherein said filter material contains fibrous activated carbon.

17. The shower unit according to claim 13, wherein said filter material contains a sulfite.

18. The shower unit according to claim 17 wherein said sulfite is calcium sulfite.

19. The shower unit according to claim 13, wherein said filter material is provided in a housing, and a part of or the whole of said housing is transparent.

20. The shower unit according to claim 13, further comprising a reinforcement member with a water permeable property provided on a periphery of said filter material.

21. The shower unit according to claim 20, wherein said reinforcement member with a water permeable property is layered around the periphery of said filter material.

22. The shower unit according to claim 20 or 21, wherein said reinforcement member with a water permeable property is formed from a nonwoven fabric.

23. The shower unit according claim 20 or 21, wherein a pressure loss due to said reinforcement member with a water permeable property is higher than a pressure loss due to said filter material.

24. The shower unit according to claim 13, wherein a water permeation resistance at a periphery side of said filter material is greater than a water permeation resistance at an inner circumferential side of said filter material.

* * * * *

UNITED STATES PATENT AND TRADEMARK OFFICE

CERTIFICATE OF CORRECTION

PATENT NO. : 6,732,957 B2
DATED : May 11, 2004
INVENTOR(S) : Kanaya et al.

It is certified that error appears in the above-identified patent and that said Letters Patent is hereby corrected as shown below:

Column 6,
Line 34, after "water.", and before "present" please start a new paragraph -- Thus, in the flow path switching device according to the --.

Signed and Sealed this

Twenty-first Day of December, 2004

JON W. DUDAS
*Director of the United States Patent and Trademark Office*